US011143448B2

(12) United States Patent
Tsuno

(10) Patent No.: US 11,143,448 B2
(45) Date of Patent: Oct. 12, 2021

(54) TRANSPORT DEVICE

(71) Applicant: FUJIFILM Toyama Chemical Co., Ltd., Tokyo (JP)

(72) Inventor: Katsuhiro Tsuno, Tokyo (JP)

(73) Assignee: FUJIFILM TOYAMA CHEMICAL CO., LTD., Tokyo (JP)

( * ) Notice: Subject to any disclaimer, the term of this patent is extended or adjusted under 35 U.S.C. 154(b) by 150 days.

(21) Appl. No.: 16/318,453

(22) PCT Filed: Jun. 14, 2017

(86) PCT No.: PCT/JP2017/021911
§ 371 (c)(1),
(2) Date: Jan. 17, 2019

(87) PCT Pub. No.: WO2018/016238
PCT Pub. Date: Jan. 25, 2018

(65) Prior Publication Data

US 2019/0242636 A1 Aug. 8, 2019

(30) Foreign Application Priority Data

Jul. 19, 2016 (JP) ..... JP2016-141493

(51) Int. Cl.
*F25D 16/00* (2006.01)
*F25D 3/12* (2006.01)
(Continued)

(52) U.S. Cl.
CPC ..... *F25D 16/00* (2013.01); *B65D 81/18* (2013.01); *B65D 81/38* (2013.01); *F25B 21/02* (2013.01);
(Continued)

(58) Field of Classification Search
CPC ..... F25D 11/003; F25D 11/006; F25D 16/00; F25B 21/02; F25B 21/04; A61J 1/165
See application file for complete search history.

(56) References Cited

U.S. PATENT DOCUMENTS 5,842,353 A * 12/1998 Kuo-Liang ..... A47G 19/2288 62/190
5,927,085 A * 7/1999 Waldman ..... A47G 23/0258 215/395
(Continued)

FOREIGN PATENT DOCUMENTS

| | | | |
|---|---|---|---|
| JP | 4190898 | B2 | 12/2008 |
| JP | 2013-39102 | A | 2/2013 |
| JP | 2014-178106 | A | 9/2014 |
| WO | 2009/133785 | A1 | 11/2009 |

OTHER PUBLICATIONS

International Search Report dated Sep. 19, 2017, issued in counterpart application No. PCT/JP2017/021911 (2 pages).

*Primary Examiner* — Christopher R Zerphey
(74) *Attorney, Agent, or Firm* — Westerman, Hattori, Daniels and Adrian, LLP

(57) ABSTRACT

Provided is a transport device which can perform easily thermal storage temperature controlling treatment of the thermal storage material even at a cell transport destination. The transport device of the present invention includes: a thermally insulated container that has a cylindrical shape and a bottom, a thermal storage material disposed along the inner circumferential surface of the thermally insulated container, and a temperature control unit that is detachably fitted on the thermally insulated container and is for performing thermal storage temperature controlling treatment on the thermal storage material, wherein the temperature controlling unit comprises a heat transferring body for performing the thermal storage temperature control processing on the thermal storage material when the unit is fitted on
(Continued)

the thermally insulated container, and a storage space formed inside the heat-transferring body for storing a stored object so that the object can be freely put in and taken out.

14 Claims, 9 Drawing Sheets

(51) Int. Cl.

| | |
|---|---|
| ***F25D 3/06*** | (2006.01) |
| ***F25B 21/02*** | (2006.01) |
| ***B65D 81/18*** | (2006.01) |
| ***B65D 81/38*** | (2006.01) |
| ***F25D 3/00*** | (2006.01) |
| ***F25D 11/00*** | (2006.01) |
| ***F25B 21/04*** | (2006.01) |
| ***F25D 19/02*** | (2006.01) |

(52) U.S. Cl.
CPC ..... *F25D 3/00* (2013.01); *F25D 3/06* (2013.01); *F25D 3/125* (2013.01); *F25D 11/003* (2013.01)

(56) References Cited

U.S. PATENT DOCUMENTS

| | | | | |
|---|---|---|---|---|
| 6,530,232 | B1 * | 3/2003 | Kitchens | F25D 31/007 62/3.2 |
| 6,666,032 | B1 * | 12/2003 | Rickson | A61J 1/165 62/3.6 |
| 7,287,386 | B2 * | 10/2007 | Upadhye | A47J 36/2438 62/3.3 |
| 7,856,831 | B2 * | 12/2010 | Flinner | F25C 1/04 62/3.2 |
| 8,887,512 | B2 * | 11/2014 | Olsen | A47J 41/02 62/3.62 |
| 2007/0051734 | A1 * | 3/2007 | Kuhn | F25D 3/06 220/592.27 |
| 2009/0049845 | A1 * | 2/2009 | McStravick | A61M 5/003 62/3.62 |
| 2010/0282762 | A1 * | 11/2010 | Leonard | B65D 81/3841 220/592.01 |
| 2011/0073603 | A1 | 3/2011 | Saho et al. | |
| 2012/0312031 | A1 | 12/2012 | Olsen et al. | |
| 2017/0056289 | A1 | 3/2017 | Tsuno | |
| 2019/0145688 | A1 * | 5/2019 | Tsuno | B65D 81/3846 62/129 |
| 2019/0162460 | A1 * | 5/2019 | Oh | F25D 16/00 |

* cited by examiner

TRANSPORT DEVICE

FIELD OF THE INVENTION

The present invention relates to a transport device, and more particularly to a transport device suitable for transporting a sample or chemical in a predetermined temperature range.

BACKGROUND ARTS

In regenerative medicine, tissues and iPS cells collected from patients and the like are processed according to the purpose of treatment, and the cells thus processed are transplanted to a patient. When such cells and tissues are processed in a Cell Processing Center (CPC), it is necessary to transport the tissues collected from a patient in a medical institution to the CPC, or to transport the cells processed in the CPC to the medical institution.

When transporting samples such as collected tissues and processed cells, it is required that transport is carried out while maintaining a desired temperature according to the type of sample in order to suppress deterioration of the sample.

In order to satisfy these requirements, there is proposed, as mentioned below, a transport container where an outer container which is made of a vacuum heat insulating panel is combined with an inner container which installs a heat storage material therein.

PRIOR ARTS

Patent Literature

Patent Literature 1: Japanese Patent No. 4190898

SUMMARY OF INVENTION

Problems to be Solved by the Invention

By the way, this type of transport device is used for transporting from the medical institution of the patient to the CPC, and for returning from the CPC of the processed cell to the medical institution.

However, in the above transport device, when a transported object is delivered from, for example, the medical institution to the CPC, the heat insulation by the heat storage material is almost finished. Therefore, when the transported object is taken out, the transport device is returned in an empty state. Namely, it is difficult for the transport device used for transporting the transported object to be used for returning the processed goods. This is because the heat storage treatment of the heat storage material requires complicated time management and temperature control according to the size and transporting temperature of the heat storage material.

The object of the present invention is to provide a transport device which can perform easily thermal storage temperature controlling treatment of the thermal storage material even at a cell transport destination.

Means for Solving the Problem

In order to solve the above problem, the present invention is to provide a transport device including: a thermally insulated container that has a cylindrical shape and a bottom, a thermal storage material disposed along the inner circumferential surface of the thermally insulated container, and a temperature control unit that is detachably fitted on the thermally insulated container and is for performing thermal storage temperature controlling treatment on the thermal storage material, wherein the temperature controlling unit comprises a heat transferring body for performing the thermal storage temperature control processing on the thermal storage material when the unit is fitted on the thermally insulated container, and a storage space formed inside the heat-transferring body for storing a stored object so that the object can be freely put in and taken out.

In the transport device of the present invention having the above construction, it is preferable that the heat transferring body is formed so as to face an inner circumferential surface of the heat storage material in the state where the temperature controlling unit is attached to the thermally insulated container.

Further, in the transport device of the present invention having the above construction, it is preferable that the temperature controlling unit has a lid that can close the storage space so as to freely open and close.

Further, in the transport device of the present invention having the above construction, it is preferable that a first temperature sensor for measuring a temperature of the heat storage material further included, and the temperature controlling unit comprises a controller for controlling the temperature of the heat transferring body on the basis of a measurement signal of the first temperature sensor.

Further, in the transport device of the present invention having the above construction, it is preferable that a second temperature sensor for measuring a temperature of the heat transferring body is further included, and the controller further controls the temperature of the heat transferring body on the basis of a measurement signal of the second temperature sensor.

Further, in the transport device of the present invention having the above construction, it is preferable that the temperature controlling unit has an electronic cooling element for cooling the heat transferring body.

Further, in the transport device of the present invention having the above construction, it is preferable that the controller performs with respect to the heat transferring body; a first process for performing a heat storage treatment on the heat storage material until a temperature on a side opposite to the heat transferring body in the heat storage material reaches a first temperature corresponding to the heat storage material, a second process of performing a temperature controlling treatment on the heat storage material so that a temperature of the heat storage material side in the heat storage material which is subjected to the heat storage treatment becomes a second temperature suitable for transport the transported object; and a third process for maintaining the temperature of the heat storage material so that the heat storage material is maintained at the second temperature.

Further, the present invention is to provide a transport device including: a thermally insulated container that has a cylindrical shape and a bottom, and a temperature control unit that is detachably fitted on the thermally insulated container and is for performing thermal storage temperature controlling treatment on a thermal storage material disposed along the inner circumferential surface of the thermally insulated container, wherein the temperature controlling unit comprises a heat transferring body for performing the thermal storage temperature control processing on the thermal storage material when the unit is fitted on the thermally insulated container, and a storage space formed inside the heat-transferring body for storing a stored object so that the object can be freely put in and taken out.

Effects of the Invention

When using the transport device of the present invention, it is possible to perform easily thermal storage temperature controlling treatment of the thermal storage material even at a cell transport destination.

EMBODIMENTS FOR ACHIEVING THE INVENTION

Hereinafter, representative embodiments of the present invention will be described in detail with reference to the drawings, but the present invention is not limited thereto. Since the drawings are for conceptually explaining the present invention, the dimensions, ratios or numbers are exaggerated or simplified in some cases for easy understanding.

In the following description, according to the present invention where samples (transported object 90) such as sampled cells and cultured (processed) tissues are transported while being stored in the transport device, other materials such as chemicals which require temperature controlling may be stored in the transport device. In this embodiment, regenerative medicine such as autologous transplantation, in which, for example, a patient's tissue is collected, cells are cultured, and transplanted into the original patient, are typically assumed. In this case, since the cells to be transported are cells for one serving a small amount, the transport device may have a size corresponding to the transported cells. In most cases, the actual storage capacity of the transport device is only 1.0 L to 2.0 L.

[Construction of the Transport Device]

Figure 1:
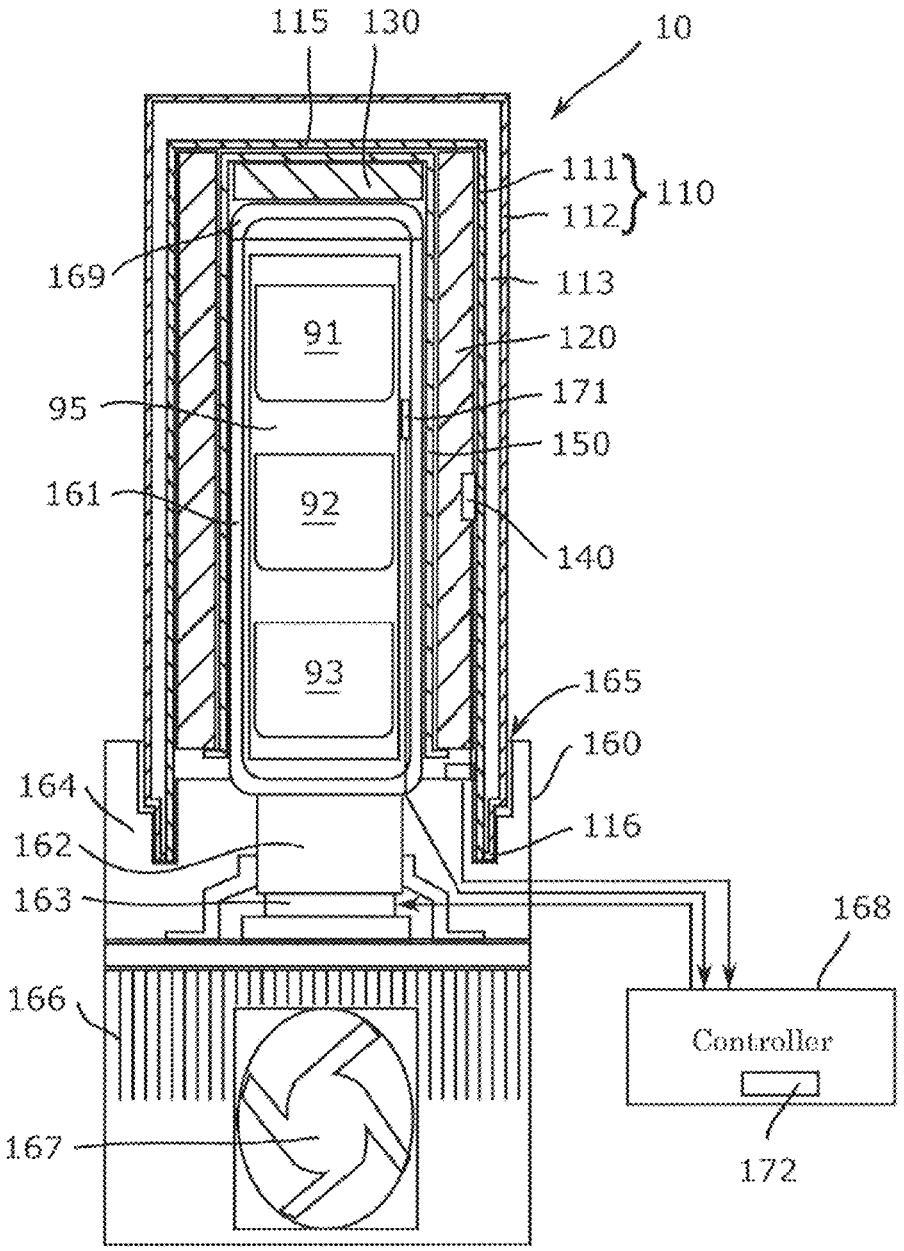
FIG. 1 is a view showing the transport device according to the embodiment of the present invention.
Figure 5A:
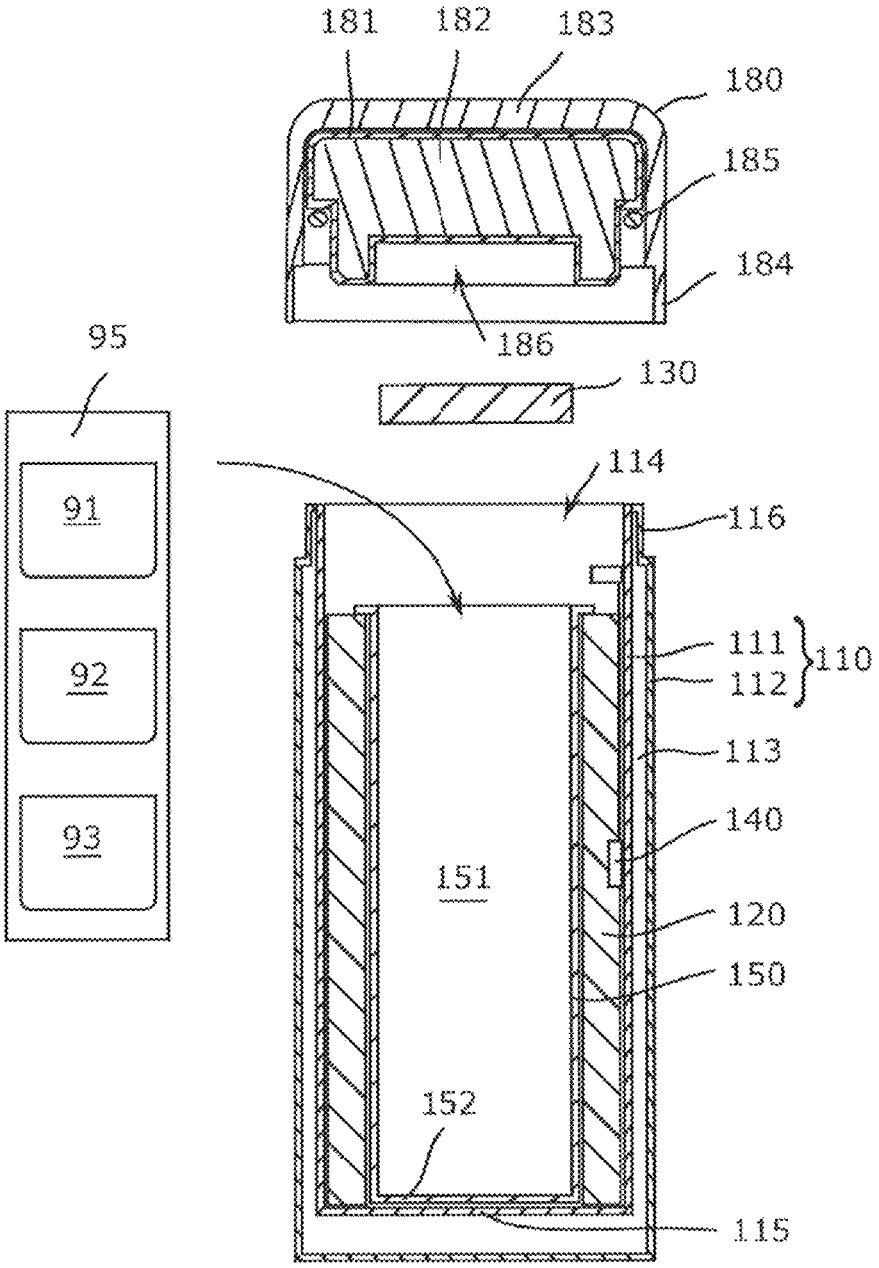
FIG. 5A is a view showing how to attach the lid to the double wall container in the embodiment of the present invention.
Figure 5B:
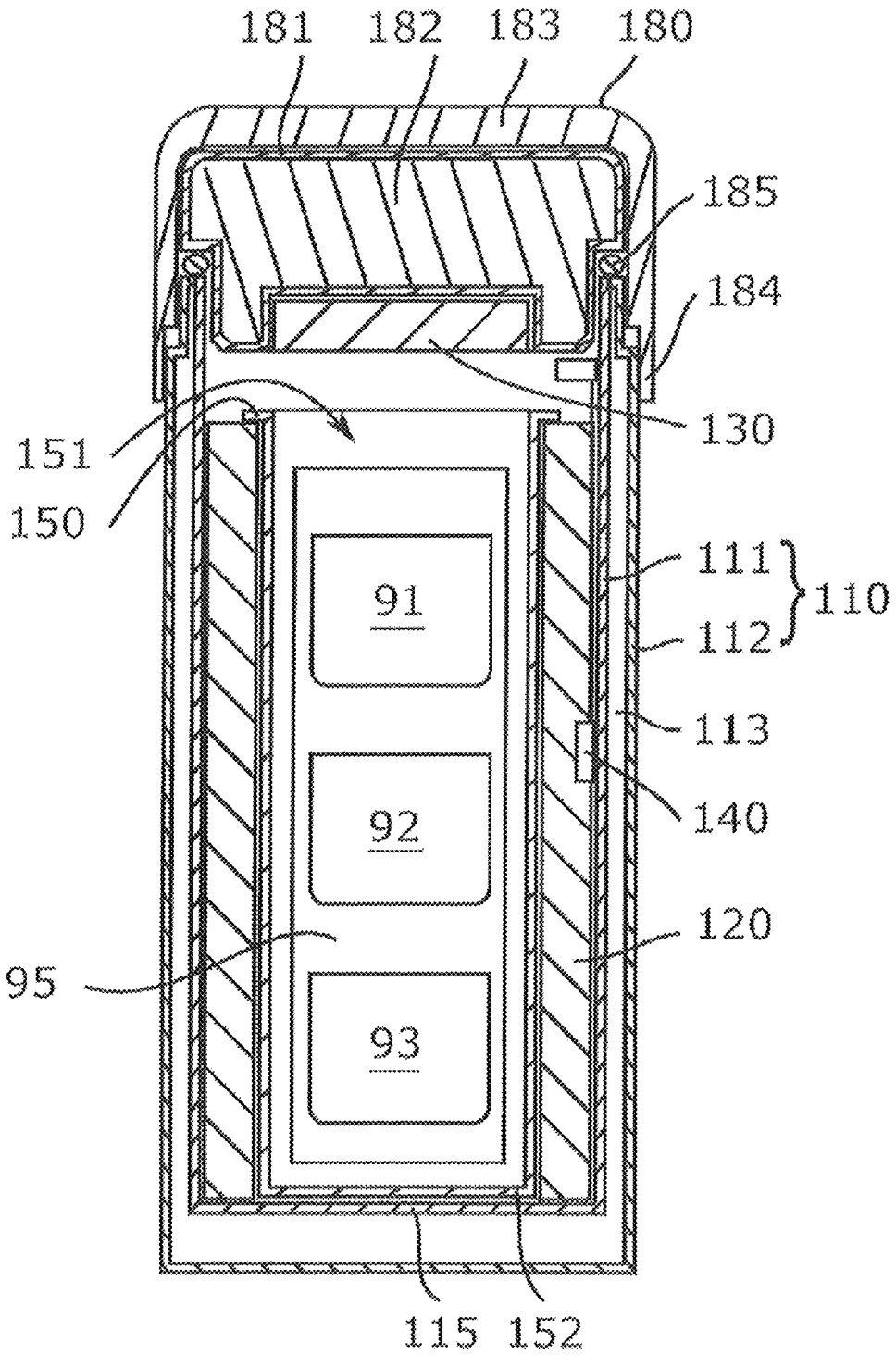
FIG. 5B is a view showing the state where the lid is attached to the double wall container in the embodiment of the present invention.
Figure 6:
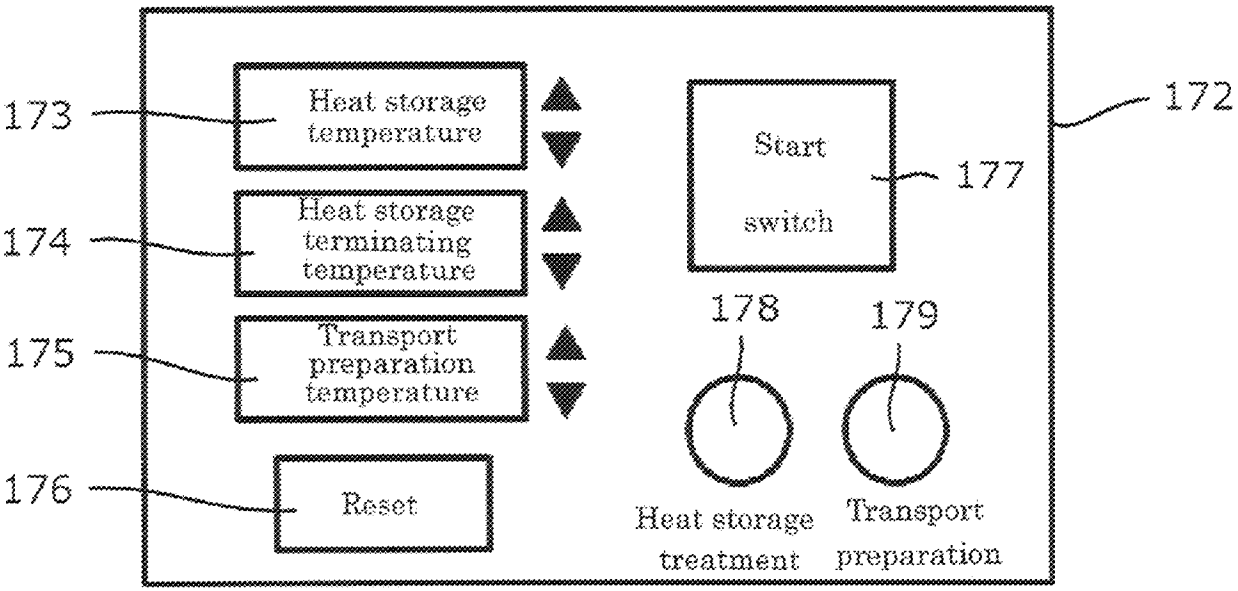
FIG. 6 is a view showing the operation part of the temperature controlling device which constitutes the transport device according to the second embodiment of the present invention.

A transport device 10 according to the embodiment will be described with reference to the drawings. As shown in FIG. 1, the transport device 10 includes a double wall container 110, a heat storage material 120, an auxiliary heat storage material 130, a temperature sensor 140, a storage container 150, and a temperature controlling device 160. The transport device 10 may include, for example, a lid 180 as shown in FIG. 5A and FIG. 5B.

(Double Wall Container)

The double wall container 110 is a thermally insulated container having a tubular shape, and includes an inner wall 111 and an outer wall 112 as shown in FIG. 1. In the present embodiment, the double wall container 110 has a cylindrical shape, but it may have, for example, an elliptical shape or a rectangular parallelepiped shape. The thickness between the two walls on the peripheral surface of the double wall container 110 may be appropriately selected according to the desired capacity and processing accuracy of the transport device 10. In the present embodiment, it may be selected from the range of 2 mm to 10 mm, for example. Further, the thickness between the two walls at a bottom portion 115 (the portion to be evacuated) of the double wall container 110 may be equal to or greater than the thickness between the two walls on the circumferential surface, and is, for example, around 10 mm in the present embodiment.

Figure 3:
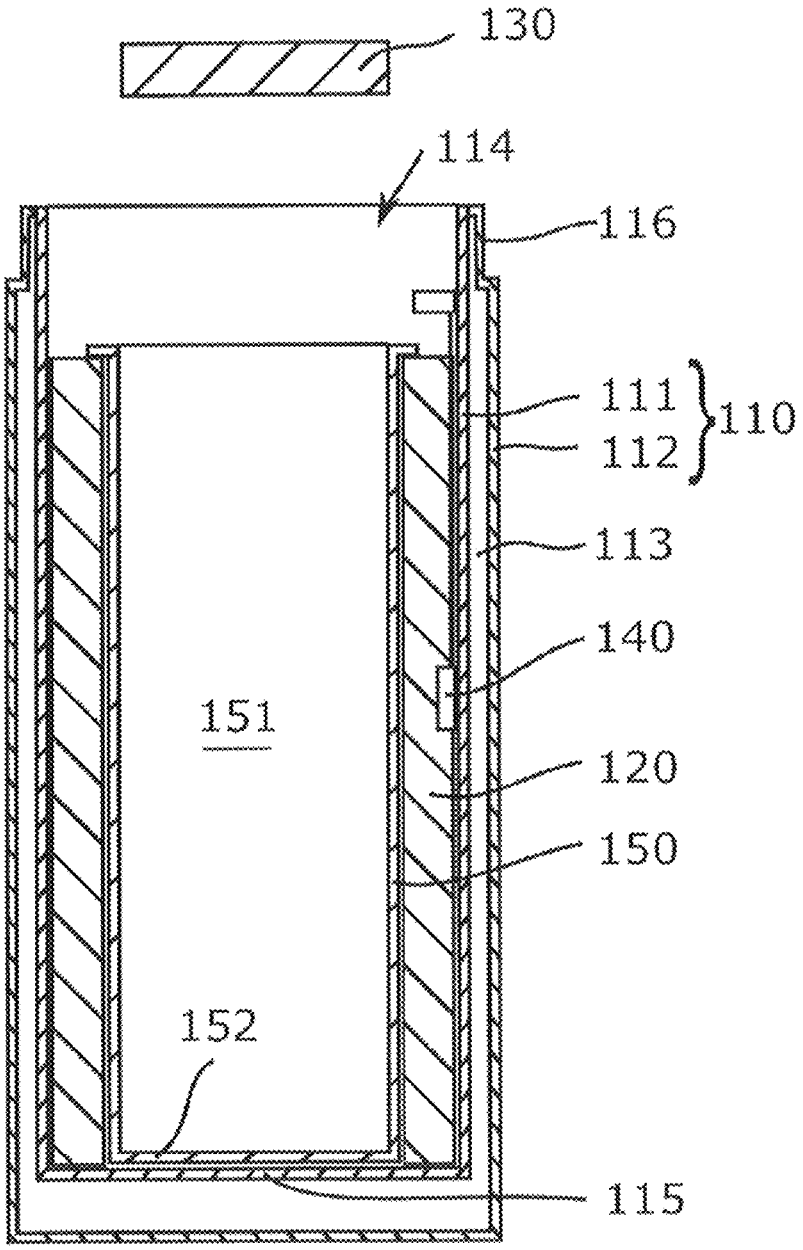
FIG. 3 is a view showing the double wall container which constitutes the transport device according to the embodiment of the present invention.

As shown in FIG. 3, the inner wall 111 is a cylindrical metal member and has a space 151 into which the heat storage material 120 and the heat transferring body 161 for temperature controlling of the temperature controlling device 160 are inserted. The heat storage material 120 and the heat transferring body 161 for temperature controlling are taken in and out through an opening portion 114 which is formed at the end portion opposite to the bottom portion 115. When the lid 180 is attached to the double wall container 110 as shown in FIG. 5A and FIG. 5B, the transported object 90 may be stored in the space 151.

In the present embodiment, the inner diameter of the inner wall 111 is substantially uniform from the bottom portion 115 to the opening portion 114. Considering the nature of the transported object 90 to be described later, when the storage volume of the transport device 10 is set to 1.0 L to 2.0 L, for example, in the case of a cylindrical double wall container, it is sufficient that the inner diameter of the inner wall 111 is 80 mm to 150 mm.

In the state where the temperature controlling device 160 is fixed to the double wall container 110, an edge portion 116 which forms the opening portion 114 of the inner wall 111 is inserted and engaged with an engaged portion 165 which is formed on a box body 164 of the temperature controlling device 10 and seals the space 151 in the double wall container 110. Further, in the case that the lid 180 is inserted and engaged with the opening portion 114 of the double wall container 110, the edge portion 116 is in contact with a sealing material 185 provided on the lid 180, and then seals the space 151 of the transport device 1.

Further, a threaded portion (not shown) is formed on an inner peripheral surface of the inner wall 111 in the vicinity of the opening portion 114. The threaded portion can engage with a threaded portion (not shown) formed on the box body 164 of the temperature controlling device 160, whereby the double wall container 110 and the temperature controlling device 160 are fixed. In addition, the threaded portion can engage with a threaded portion (not shown) formed on the lid 180, and in such a case the double wall container 110 and the lid 180 are fixed. It should be noted that the threaded portion of the inner wall 111 may be formed on the surface of the outer wall 112 that faces the inner surface of the lid 180.

The inner wall 111 is formed, for example, by processing a stainless steel into a thin plate of 0.2 mm to 0.7 mm, preferably a thin plate of 0.5 mm or less, apart from the thickness of the portion extended by the press. The stainless steel is a material with a relatively small thermal conductivity.

The outer wall 112 is a cylindrical metal member like the inner wall 111, and is provided so as to cover the outer side of the inner wall 111. The outer wall 112 is joined at the edge portion 116 in the state where the space 113 between the outer wall and the inner wall 111 is in a reduced pressure. Therefore, the space 113 is a vacuum, and the double wall container 110 has a high heat insulating property. In the present embodiment, the outer wall 112 is formed, like the inner wall 111, by processing a stainless steel into a thin plate of 0.2 mm to 0.7 mm, preferably a thin plate of 0.5 mm or less.

In addition, the double wall container 110 may have a narrowed portion which protrudes from the inner peripheral surface of the inner wall 111. The narrowed portion is provided in the vicinity of the opening portion 114 of the inner container 110, and improves the heat insulating property of the transport device 10 by reducing the cross-sectional area to contribute to the heat transfer.

Further, when the double wall container 110 has a shape other than a cylindrical shape, such as a substantially prismatic shape, it cannot be fitted by inserting the double wall container 110 into the temperature controlling device 160 and rotating it. Therefore, a fixing means such as a latch is provided on the outer peripheral surface of the double wall container 110 and the double wall container 110 is fixed to the temperature controlling device 160 via the fixing means, so that the sealing state of the inside of the double wall container 110 may be secured.

(Heat Storage Material)

The heat storage material 120 is, for example, a latent heat storage material, and is provided for utilizing heat absorption or heat generation due to the phase change to maintain the temperature around the heat storage material in the vicinity of the phase change temperature. The heat storage material 120 is disposed along the inner peripheral surface of the inner wall 111 of the double wall container 110. The heat storage material 120 may be disposed so as to cover the bottom portion 115 of the double wall container 110.

In order to facilitate the heat storage treatment mentioned bellow and to keep the temperature in the space 151 within a certain range during the transporting, the heat storage material 120 has a substantially uniform thickness from the bottom portion 115 of the inner wall 111 to the vicinity of the opening portion 114. Here, the substantially uniform thickness is synonymous with the fact that the time required for the heat storage treatment of the heat storage material 120 is approximately the same regardless of the part of the heat storage material 120.

The heat storage material 120 is, for example, a paraffin-based or fatty acid-based hydrocarbon material such as a normal paraffin. In this type of heat storage material, by making the composition of the material different, it is possible to obtain a heat storage material that stores heat in the specific temperature zone within the range, for example, of 0° C. to 50° C. Thereby, it possible to maintain the temperature in the space 151 at a desired temperature from the refrigeration temperature to a temperature close to the body temperature. The heat storage material 120 may be a material other than the hydrocarbon based material. Further, it is also possible to use a heat storage material in a freezing region where the phase change is 0° C. or less, dry ice, or the like.

The heat storage material 120 is formed in a sheet-like or a plate-like and has a substantially uniform thickness. The heat storage material 120 may previously be formed in a cylindrical shape. Further, the heat storage material 120 is solid after the heat storage, and gel-like before the heat storage. It is preferable that the heat storage material 120 can retain its shape as a single body without the storage container 150 mentioned bellow. When using the heat storage material 120, the heat storage material 120 having a size corresponding to the size of the space 151 of the transport device 10 is prepared. Further, for example, when the transporting temperature suitable for sending a sample from the medical institution to CPC differs from the transporting temperature suitable for returning the sample from the CPC to the medical institution, in order to transport and return the sample, heat storage materials having different temperature zones may be used.

The heat storage material 120 is heat-stored in the temperature controlling manner by a temperature controlling device 160. For example, when the temperature of the normal paraffin-based heat storage material 120 having a thickness of 2 cm and a weight of 236 g is controlled from 25° C. to 18° C. by the temperature controlling device 160 in the state of being stored in the double wall container 110, the time required for temperature controlling is about 2 hours (for example, see FIG. 7).

(Auxiliary Heat Storage Material)

Figure 2:
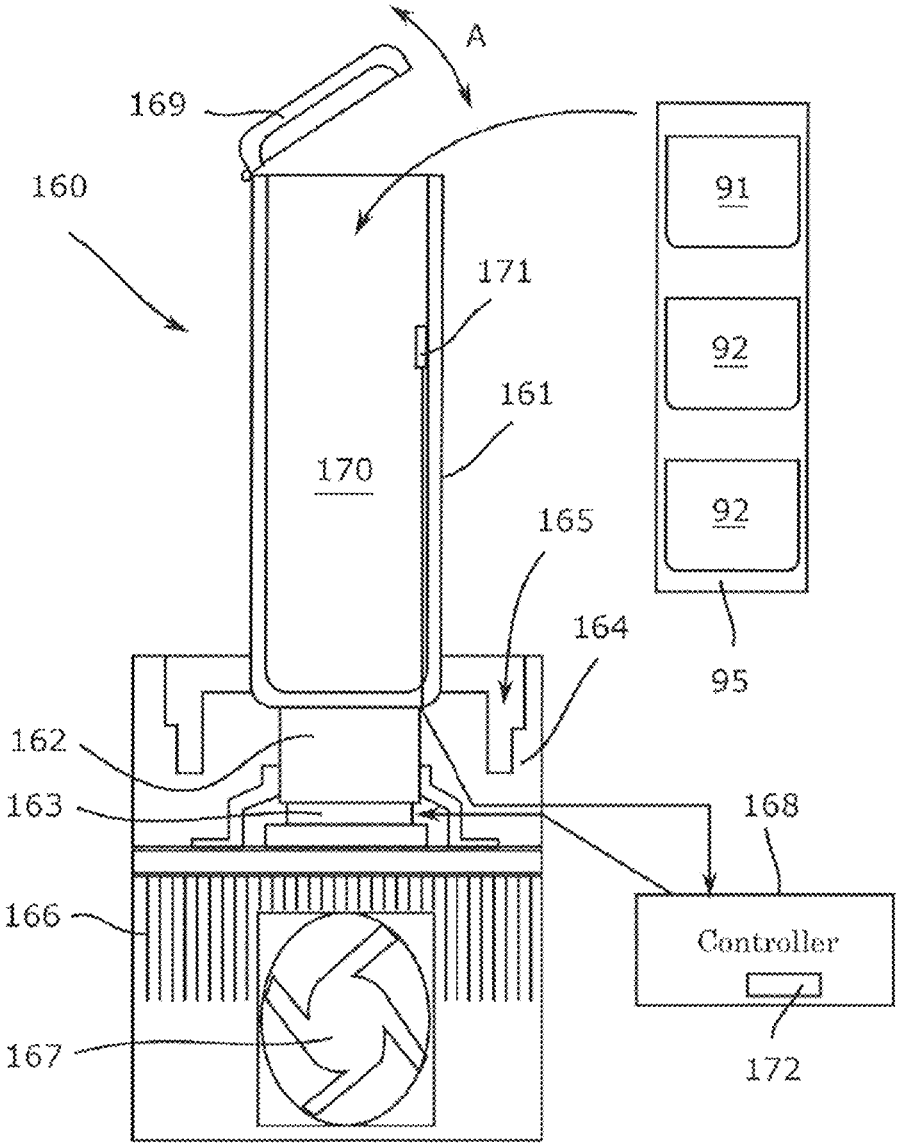
FIG. 2 is a view showing the temperature controlling device which constitutes the transport device according to the embodiment of the present invention.

As shown in FIG. 2, in the inner plug 121 of the inner lid 120, a recess 126 is formed on the surface of the inner container 120 facing the storage space 116 of the inner container 110, and the auxiliary heat insulating material 131 is detachably attached in the recess 126. By providing the auxiliary heat storage material 127 on the upper surface side of the storage space 116, the temperature distribution in the storage space 116 can be made more uniform, and thus more accurate temperature controlling can be continued. In this respect, since the bottom portion of the inner container 110 is the portion where the heat is most difficult to escape, it is easy to keep the temperature constant even without installing the heat storage material (of course, the heat storage material may be installed at the bottom of the inner container 110). On the other hand, since the opening portion of the inner container 110 is a portion where the heat easily escapes, the effect of installing the heat storage material is high in order to stabilize the inside temperature of the container.

For example, as shown in FIG. 1, when the double wall container 110 is mounted on the temperature controlling device 160, the auxiliary heat storage material 130 may be disposed between the bottom portion 115 of the double wall container 110 and the heat transferring body 161 of the temperature controlling device 160. In addition, as shown in FIG. 5A and FIG. 5B, when the lid 180 is attached to the double wall container 110, the auxiliary heat storage material 130 may be detachably attached to a recess 126 formed in the lid 180. In either case, the auxiliary heat storage material 131 can make the temperature distribution in the storage space 170 more uniform, and thus more accurate temperature controlling can be continued. In addition, when the lid 180 is attached to the double wall container 110, since the opening portion 114 of the double wall container 110 is a region where heat easily escapes, it is highly effective that the auxiliary heat storage material 130 is disposed in order to stabilize the inside temperature of the container.

The auxiliary heat storage material 131 has a disc shape. The thickness of the auxiliary heat storage material 131 is preferably the same as the thickness of the heat storage material 120 in terms of management of the heat storage treatment. Further, the auxiliary heat storage material 127 is desirably a size slightly smaller than the bottom portion 152 of the storage container 150 so that the heat storage treatment for temperature controlling can be performed by the temperature controlling device 160 together with the heat storage material 120.

(Temperature Sensor)

A temperature sensor 140 is provided between the double wall container 110 and the heat storage material 120. The temperature sensor 140 is, for example, a thermistor or a thermocouple. The temperature sensor 140 measures the temperature of the heat storage material 120 and outputs the measured data to the temperature controlling device 160, while the heat storage treatment is being performed in the temperature controlling device 160. Thereby, it is possible to appropriately manage the time required for the heat storage treatment.

Specifically described, the temperature sensor 140 measures the temperature on the double wall container 110 side of the heat storage material 120. More specifically, the temperature sensor 140 measures the temperature of the surface opposite to a temperature-controlling heat transferring body 161 in the thickness direction of the heat storage material 120. The reason is that, when the phase change temperature of the heat storage material 120 is higher than the outside air in the thickness direction of the heat storage material 120, the heat moves from the inside to the outside, and the above surface is the portion requiring the longest time for the heat storage treatment. The temperature controlling device 160 determines the completion of the heat storage treatment based on the output of the temperature sensor 140, as explained in relation with FIG. 7 bellow.

A plurality of temperature sensors 140 may be provided so as to measure the temperature at a plurality of portions having different distances from the inner peripheral surface of the heat storage material 120. For example, in the case of a large container, it is possible to perform more precise management of the heat storage treatment.

The temperature sensor 140 may measure the temperature of the heat storage material 120 during transport of the transported object 90. Thereby, it is possible to control the temperature during transporting. A recorder for recording at least one of temperature, vibration, and barometric pressure in the space 151 may be disposed in the space 151. Thereby, it is easy to manage the environment of the space 151. Such a recorder may be built in, for example, a temperature controlling device 160 or the lid 180 described bellow.

(Storage Container)

The storage container 150 may be provided so as to be in contact with the inner surface of the heat storage material 120. The storage container 150 is made of, for example, a heat conductive metal member such as aluminum, and has a tubular shape in the present embodiment. The storage container 150 is manufactured by shaping a thin plate having a thickness of about 1 mm on which a surface treatment such as the alumite treatment has been applied into a cylindrical shape. A bottom portion 152 that covers the end portion is formed at the end portion on the inner wall 115 side of the storage container 150. It is to be noted that the storage container 152 may have, for example, an elliptical shape or a rectangular parallelepiped shape.

Since the heat storage material 120 is a sheet-like or plate-like member formed by filling a soft resin film with a gel-like heat storage material, when the heat storage material is inserted into the double wall container 110, there is a case that the heat storage material 120 may not be disposed along the inner surface of the inner wall 111 of the double wall container 110. Therefore, by inserting the storage container 150 into the inside of the heat storage material 120, the heat storage material 120 is surely disposed along the inner wall 111 of the double wall container 110.

The storage container 150 further has a function that the heat can be uniformly transferred from a temperature controlling heat transferring body 161 of the temperature controlling device 160 to the heat storage material 120 during the heat storage treatment of the heat storage material 120. This function contributes to shortening the heat storage treatment of the heat storage material 120. In addition, the storage container 150 has a function that the heat can be uniformly transferred from the heat storage material 120 to the transported object 90 in the storage space 170 when the transported object 90 is transported. This function contributes to maintaining the temperature in the storage space 170 within a certain temperature zone.

When the lid 180 is attached to the double wall container 110, the transported object 90 is stored in the space 151 in the storage container 150 as shown in FIG. 5A and FIG. 5B. In addition, the storage container 150 may be omitted. In this case, the inside of the heat storage material 120 forms the storage space.

Alternatively, the heat storage material cartridge may be configured by attaching the heat storage material 120 to the outer peripheral surface of the storage container 150 so that the storage container 150 and the heat storage material 120 can be exchanged integrally. When a plurality of the heat storage material cartridges having different temperature zones are prepared, in the case where the transporting conditions (particularly transporting temperature) are different between the forward pass and the return pass between the medical institution and the CPC, by replacing the heat storage material cartridge, it can be handled conveniently. At the time for the heat storage treatment and the sample transport, firstly, the auxiliary heat storage material 131 is placed on the bottom of the double wall container 110, and then the heat storage material cartridge is inserted into the double wall container 110.

In this case, the auxiliary heat storage material 131 preferably has the same diameter as the outer diameter of the heat storage material 120. In this way, when the transport is performed with the cap 180 attached to the double wall container 110 described bellow, since the auxiliary heat storage material 131 can close the opening portion of the container 150, the heat insulating effect of the double wall container 110 is improved.

In the case where such a heat storage material cartridge is employed, in order to facilitate attachment of the heat storage material cartridge to the double wall container 110, it is suitable to employ a double wall container that has the opening portion 114 having substantially the same inner diameter across the height direction.

(Temperature Controlling Device)

The temperature controlling device 160 performs the heat storage temperature controlling treatment on the heat storage material 120 and the auxiliary heat storage material 130 in the heat storage temperature controlling treatment. Further, the temperature controlling device 160 can maintain the heat storage material 120 and the auxiliary heat storage material 130 at a predetermined transporting temperature during the transport.

For example, as shown in FIG. 2, the temperature controlling device 160 includes the temperature controlling heat transferring body 161, a heat transferring body 162, a cooling element 163, a radiator 166, a box body 164, a controller 168, a temperature sensor 171, and an operating unit 172. Note that the temperature controlling device 160 may include a built-in power source such as a battery or a power cord for supplying power from an external power source.

In FIG. 1, FIG. 2, FIG. 4A and FIG. 4B, for the sake of convenience, the controller 168 is described to be provided separately from the temperature controlling device 160, but in the present embodiment, the controller 168 is incorporated in the temperature controlling device 160 It is, however, the controller 168 may be detachably provided from the temperature controlling device 160 so that the operator can carry the controller 168.

The temperature controlling heat transferring body 161 is a hollow member having a tubular shape and transfers the heat from the cooling element 163 to the heat storage material 120 and the auxiliary heat storage material 130, and also can accommodate the transported object 90 in the storage space 10 formed in the temperature controlling heat transferring body. The temperature controlling heat transferring body 161 is made of, for example, a metal material having a high thermal conductivity like aluminum.

The temperature controlling heat transferring body 161 has an outer diameter smaller than the inner diameter of the storage container 150 so as to be inserted into the space 151 along the inner peripheral surface of the storage container 150. The temperature controlling heat transferring body 161 also has a lid 169 for closing the opening which communicates with the storage space 170. In the present embodiment, the lid 169 is attached to the upper end portion of the temperature controlling heat transferring body 161 so as to be rotatable in the direction indicated by the arrow A in FIG. 2, for example, via a hinge.

In the storage space 170, an arbitrary number of the transported objects 90, for example, transported objects 91 to 93 may be stored. The transported object 90 may be stored in the space 151 while being stored in the secondary container 95.

The temperature of the temperature controlling heat transferring body 161 may be measured by the temperature sensor 171. The measurement result of the temperature sensor 171 is used for temperature control management as will be described later with reference to FIG. 7.

The heat transferring body 162 transfers the heat from the temperature controlling heat transferring body 161 to the cooling element 163, and transfers the heat from the cooling element 163 to the temperature controlling heat transferring body 161. The heat transferring body 162 is fixed to the temperature controlling heat transferring body 161 with, for example, a screw.

The cooling element 163 is, for example, a Peltier element, and cools or heats the heat transferring body 162 on the basis of an order from the controller 168. In the temperature controlling of the freezing region, a Stirling cooler or the like having a cooler for cooling by a Stirling cycle may be used in the same manner.

The heat transferring body 162 and the cooling element 163 mentioned above are housed in a box body 164 having heat insulating property. The box body 164 has a fitting portion 165 into which an edge portion 116 of the double wall container 110 is fitted. The inside of the double wall container 110 is hermetically sealed by fitting the edge portion 116 of the double wall container 110 to the fitting portion 165 of the temperature controlling device 160, so that the heat leakage during the heat storage treatment and transporting is suppressed.

The radiator 166 is, for example, a heat sink and emits the heat in the cooling element 163. A fan 167 discharges the heat emitted from the radiator 166 to the outside of the temperature controlling device 160.

The controller 168 manages the heat storage temperature controlling treatment on the basis of the temperature information output from the temperature sensor 171 of the double wall container 110 and the temperature sensor 140 of the transport device 10. The heat storage temperature controlling treatment by the controller 168 will be described later with reference to FIG. 7.

The operating unit 172 is an interface with the user and also is a display unit that indicates the progress of the heat storage temperature controlling treatment. The operation unit 172 includes a heat storage temperature setting button 173, a heat storage terminating temperature setting button 174, a transport preparation temperature setting button 175, a reset button 176, a start switch 177, a heat storage treatment completion lamp 178, and a transport preparation completion lamp 179.

The heat storage temperature setting button 173, the heat storage terminating temperature setting button 174, and the transport preparation temperature setting button 175 are operation buttons for setting the heat storage temperature, the heat storage terminating temperature, and the transport preparation temperature, respectively. After setting each of these temperatures, by pressing the start switch 177, the heat storage temperature controlling treatment is started. Further, by pressing the reset button 176, each temperature can be set again. After the start of the heat storage temperature controlling treatment, when the heat storage treatment is completed, the heat storage treatment completion lamp 178 is turned on, and then, when preparation for transport is completed, the transport preparation completion lamp 179 lights up. With these lamps, the user can easily grasp the progress status of the heat storage temperature controlling treatment.

Note that the operation unit 172 may have a display (not shown) which displays the set heat storage temperature, heat storage terminating temperature, transport preparation temperature, the temperature information output from the temperature sensor 171 of the double wall container 110 and the temperature sensor 140 of the transport device 10.

The controller 168 may have a wireless module (not shown) which sends the information on the state of the heat storage treatment (for example, termination of the heat storage treatment or the expiration of the heat storage time) and the information on the environment in the container (for example, internal temperature of the container) to a portable terminal (for example, a mobile phone, a smartphone, a tablet terminal) of the operator or a server.

(Lid)

The transport device 10 may have a lid 180 attached to the opening portion 114 of the double wall container 110. The lid 180 is used, for example, to transport the transported object 90 lightweight and compactly. In this case, the transported object 90 is stored in the space 151 in the double wall container 110.

The lid 180 is constituted by the inner plug 181 and the cap 183, and may be constituted separately or may be constituted integrally. In side of the inner plug 181, there is provided a heat insulating member 182 such as an urethane foam and a polystyrene foam. The inner plug 121 has a portion which enters the double wall container 110 and is in close contact with the double wall container 110. For example, a threaded portion (not shown) for fixing the inner plug 181 to the double wall container 110 is formed in the cap 183 and engages with a threaded portion (not shown) formed on the outer periphery of the double wall container 110 to bring the inner plug 181 into close contact with the double wall container 110. The cap 183 may be made of, for example, a heat insulating material such as a polypropylene foam.

The lid 180 may have a recess (concave portion) 186 where the auxiliary heat storage material 130 is mounted on the side which faces the space 151 of the double wall container 110. In addition, the lid 180 may have an extension portion or creeping portion 184 which extends along the outer circumferential surface of the double wall container 110 in order to enhance the heat insulating property by increasing the heat transfer creepage distance. Also, in the state where the lid 180 is fitted in the opening portion 114 of the double wall container 110, the lid 180 may have a sealing material 185 which comes into contact with the edge portion forming the opening portion 114, and seals the space 151 of the double wall container 110.

[Method of Using Transport Device]

A method of using the transport device 1 will be explained with reference to FIG. 4A, FIG. 4B, FIG. 5A, FIG. 5B, FIG. 6, and FIG. 7.

Firstly, the procedure for controlling the heat storage temperature of the heat storage material 120 in the double wall container 110 by the temperature controlling device 160 will be explained.

Figure 4A:
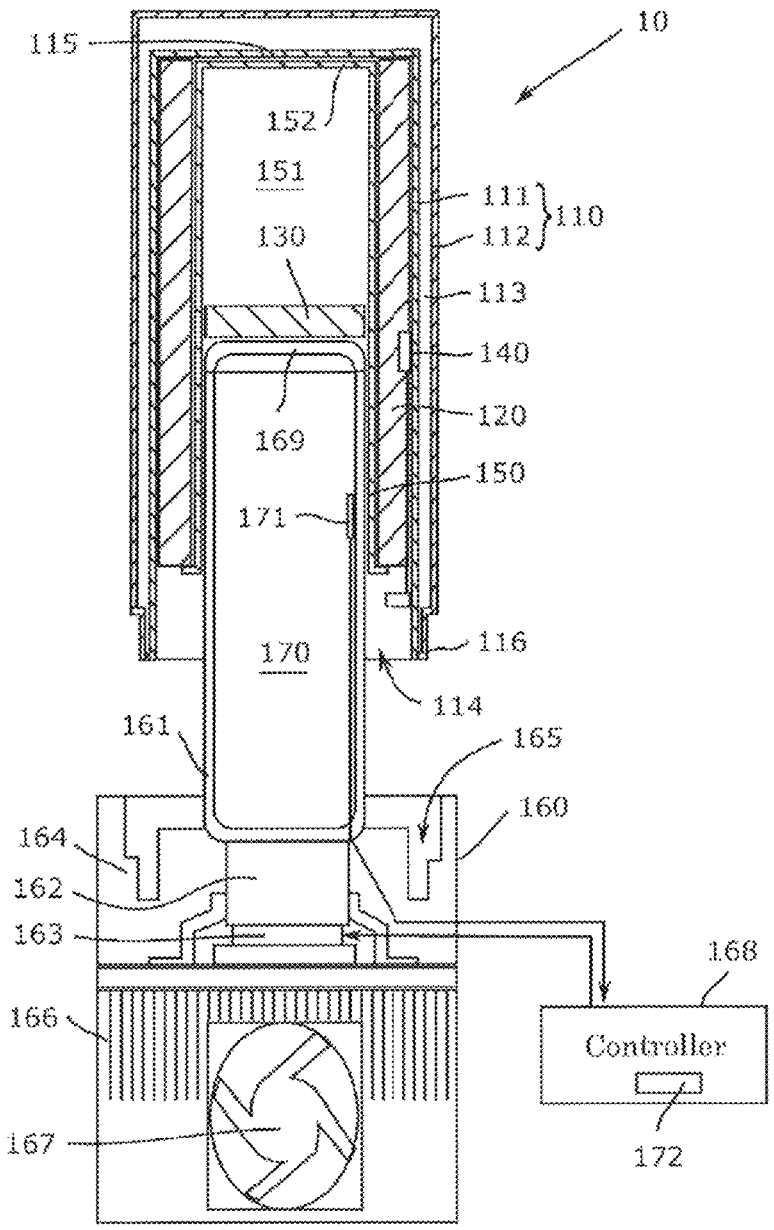
FIG. 4A is a view showing how to attach the double wall container to the temperature controlling device in the embodiment of the present invention.
Figure 4B:
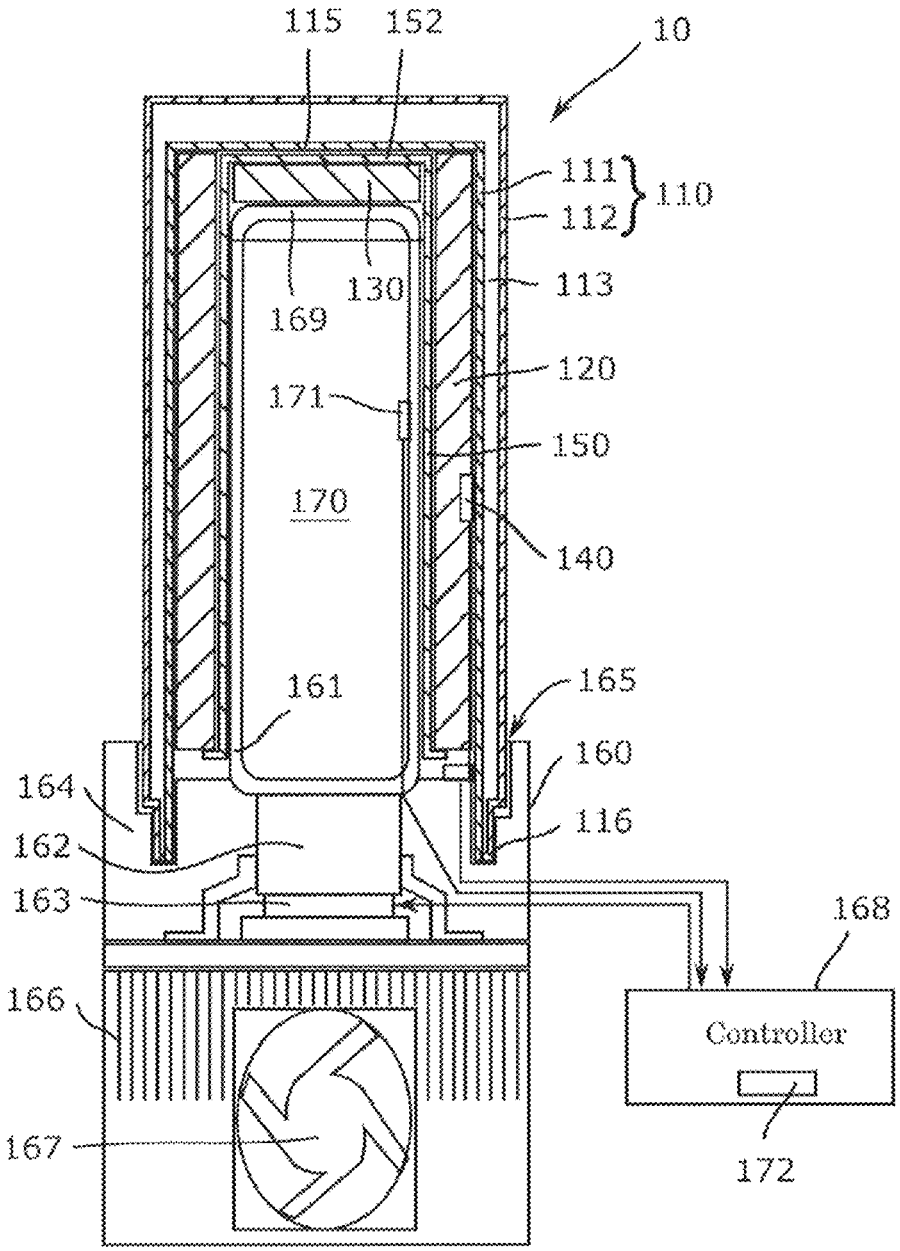
FIG. 4B is a view showing the state where the double wall container is attached to the temperature controlling device in the embodiment of the present invention.

The transport device 10 is prepared, and as shown in FIG. 4A, the double wall container 110 is inserted so as to cover the temperature controlling heat transferring body 161. At that time, the auxiliary heat storage material 131 is arranged between the temperature controlling heat transferring body 161 and the bottom of the storage container 150. Next, as shown in FIG. 4B, the opening portion 114 of the double wall container 110 is fitted into the fitting portion 165 of the temperature controlling device 160 and the cord of the temperature sensor 140 is connected to the controller 168 of the temperature controlling device 160. Alternatively, when the double wall container 110 has a shape other than the cylindrical shape, the double wall container 110 may be fixed to the temperature controlling device 160 via the fixing means provided on the outer peripheral surface of the double wall container 110. In this way, the attachment of the double wall container 110 to the temperature controlling device 160 is completed.

Next, when the user sets the heat storage temperature, the heat storage terminating temperature, and the transport preparation temperature, and presses the start switch 177, the heat storage treatment is started.

In the heat storage treatment, the controller 168 monitors the temperature outside the heat storage material 120 on the basis of the information of the temperature from the temperature sensor 140. When storing the heat at a temperature lower than the outside air, the temperature outside the heat storage material 120 slowly decreases with time, for example, as shown by the alternate long and short dashed line L1 in FIG. 7. When the temperature outside the heat storage material 120 decreases to the heat storage terminating temperature Thse (for example, 16° C.) which is set lower than the transporting temperature Ths (for example, 18° C.), the controller 168 terminates the heat storage treatment, and turns on the heat storage treatment completion lamp 178. At the end of the heat storage treatment, the temperature inside the heat storage material 120 is largely lowered from the transporting temperature Ths, for example, as shown by the broken line L2 in FIG. 7.

In the temperature controlling treatment following the heat storage treatment, the controller 168 controls the temperature of the heat storage material 120 so that the temperature inside the heat storage material 120 approaches the transport preparation temperature Ttr (for example, 15° C.). When the temperature inside the heat storage material 120 approaches the transport preparation temperature Ttr, the controller 168 terminates the temperature controlling treatment and turns on the transport preparation completion lamp 179.

Upon completion of the temperature controlling treatment, the double wall container 110 is removed from the temperature controlling device 160 in order to store the transported object 90 in the storage space 170. Alternatively, in the case that there is time before the transporting, the controller 168 may perform a heat keeping treatment where the temperature of the heat storage material 120 is maintained at the transport preparation temperature Ttr. In this way, the heat storage temperature controlling treatment of the heat storage material 120 can be automatically performed merely by setting the necessary temperatures.

In the state where a power can be secured, the controller 168 may perform temperature holding treatment after storing and transporting the transported object 90. As a result, the transported object 90 can be transported in a good state, and the time for transporting can be prolonged. Under the circumstances where a power cannot be secured, for example, the stored items 91 to 93 are stored in the double wall container 110 and the lid 180 may be attached to the double wall container 110 (see FIG. 5A and FIG. 5B).

Figure 7:
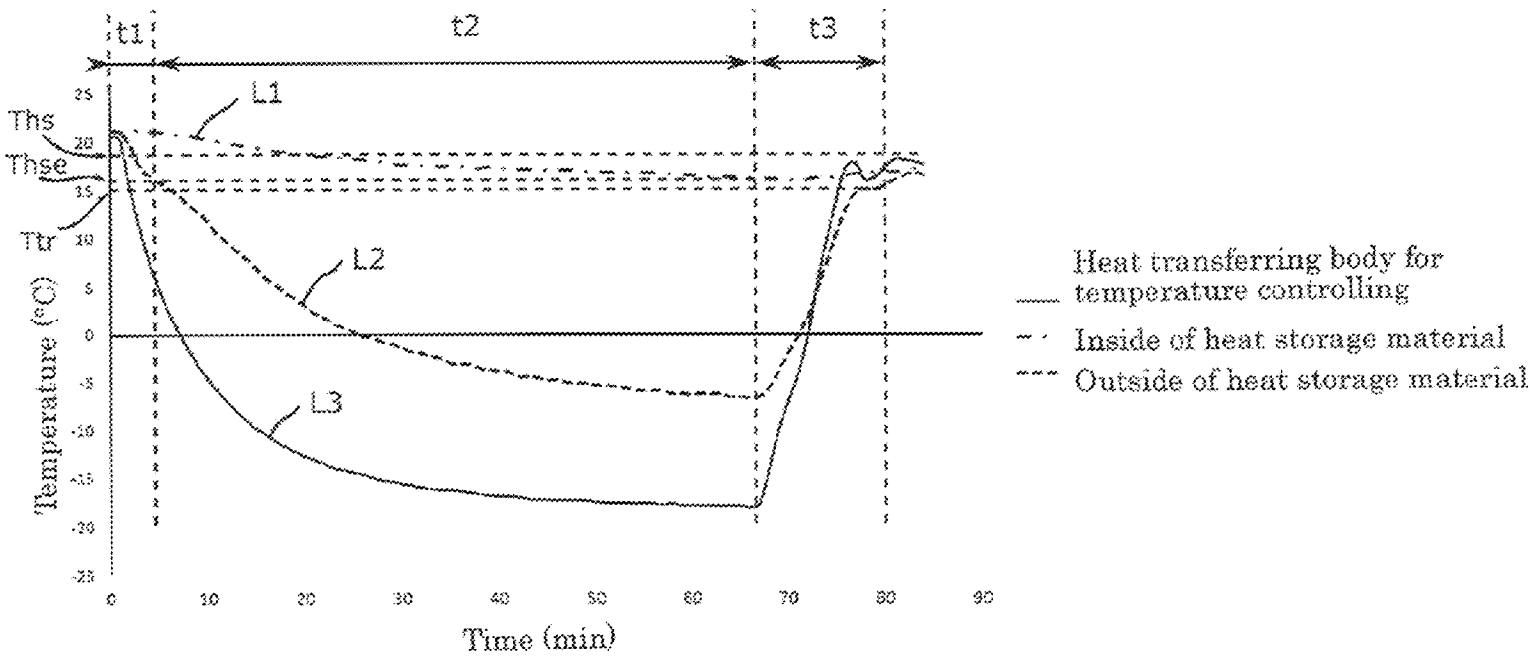
FIG. 7 is a view showing one example which shows the temperature changes of the heat storage material and the heat transferring body for temperature controlling during the heat storage temperature controlling according to the embodiment of the present invention.

Incidentally, as shown by the solid line L3 in FIG. 7, when the temperature (heat storage temperature) of the temperature controlling heat transferring body 161 during the heat storage treatment is decreased to a value which is greater than the temperature inside the heat storage material 120, the time t1 for the heat storage preparation and the heat storage time t2 is shortened. In the present embodiment, the heat storage temperature controlling treatment of the heat storage material 120 having the composition and dimension described above can be performed in about 2 hours.

As a comparative example, when heat-storing and temperature-controlling a plate-like normal paraffin based heat storage material having a thickness of 2 cm and a weight of 236 g in a refrigerator whose inside temperature is maintained at 10° C., it takes at least 9 hours to 10 hours for temperature-controlling to the heat storage temperature and to the transporting temperature. In many cases, in order to ensure the heat storage and temperature controlling treatment, it takes a long time, around 24 hours. In this way, it takes an extremely lot of time to gently heat-storing and temperature-controlling at a temperature relatively close to the transporting temperature.

Further, when the above-described normal paraffin-based heat storage material is heat-stored and temperature-controlled in a refrigerator maintained at, for example, 5° C., the heat storage time can be about 4 hours, but since, in order to control the temperature to the transporting temperature, it takes 1 hour or more, the total time is at least 5 hours or 6 hours. As described above, when the heat storage treatment is performed by increasing the temperature difference with respect to the phase change temperature, e.g. when the heat storage material 150 having a phase change temperature of 18° C. is subjected to the heat storage treatment at 0° C. or less, the heat storage treatment time is short. However, at the end of the heat storage treatment, since the temperature is excessively lower than the phase change temperature used for the transporting, it is necessary to return the temperature to a temperature that can be used for transporting, but since the thermal conduction of the heat storage material 150 is small, it takes a lot of time.

Since the heat storage material 120 subjected to the heat storage treatment is solidified and cloudy, it cannot be determined from the appearance whether the heat storage treatment has been completed or not. Therefore, it takes a sufficient time more than necessary to perform the heat storage and the temperature control.

Effect of the Present Embodiment

In the present embodiment, since the temperature controlling device 160 is inserted into the double wall container 110 and the heat storage material 120 is directly subjected to the heat storage and temperature controlling, it is possible to carry out the heat storage treatment easily. In addition, by arranging the temperature sensor 140 between the inner surface of the double wall container 110 and the heat storage material 120, it is possible to automatically determine the timing to terminate the heat storage temperature controlling treatment. Thereby, it is possible to perform sufficient heat storage temperature controlling treatment in a short time, and it is possible to avoid insufficient heat storage. Therefore, for example, at the destination such as CPC, the used heat storage material 120 can be easily subjected to the heat storage temperature controlling treatment, so that it is possible to effectively utilize the transport device 10 also at the time of returning from the CPC to the medical institution.

In addition, since the temperature controlling device 160 includes an electronic cooling element such as a Peltier element, it is possible to easily and quickly change the inside temperature of the double wall container 110 to an arbitrary set temperature. This also makes it possible to shorten the heat storage temperature controlling time of the heat storage material 120.

Further, by using the heat storage material having different temperature bands according to the transport conditions, it is possible to correspond to the transporting manner which requires different transporting temperatures for the forward and backward paths. For example, cells collected from a patient at the medical institution are transported to the CPC at a refrigeration temperature zone of about 4° C. in order to suppress the multiplication of bacteria, whereas cells prepared by the CPC are often transported from the CPC to the medical institution in a temperature zone of 18 to 20° C. Corresponding thereto, when carrying the cells from the medical institution to the CPC, a heat storage material in the cold storage temperature zone is used, and a heat storage material having a temperature zone around 20° C. is bundled together, and when the cells are returned from the CPC to the medical institution, the heat storage treatment can be performed after exchanging to the heat storage material having the temperature zone of around 20° C., and then the transport can be carried out.

In addition, since the box body 164 of the temperature controlling device 160 has heat insulating property, the inside of the double wall container 110 can be insulated from the outside. As a result, the heat storage temperature controlling treatment can be performed efficiently.

As another effect of the present embodiment, by providing the double wall container 110 having high heat insulating property and the box body 164 having the heat insulating property of the heat insulating temperature controlling device 160 which is fitted in the opening portion of the double wall container 110, it is possible to provide the transport device 10 having high heat insulating property. Therefore, the transport device 10 can maintain the transported object 90 at a desired transporting temperature for a long time.

In addition, since the thickness of the heat storage material 120 is uniform, it is possible to keep the temperature in the space 151 uniform irrespective of places. It is possible to realize a reduction in the amount of the heat storage material to be used and a reduction in the size of the transport device in combination with the high heat insulating property described above.

In addition, the auxiliary heat storage material 131 is subjected to the heat storage treatment in the temperature control device 160 together with the heat storage material 120. In the present embodiment, the thickness of the auxiliary heat storage material 131 is substantially the same as the thickness of the heat storage material 120, so that when the heat storage treatment to the heat storage material 120 is completed, the heat storage treatment to the auxiliary heat storage material 131 is also completed. Therefore, it is possible to carry out the efficient thermal storage treatment.

Further, by using the built-in power source or the external power source, it is possible to extend the transport time beyond the usable time of the heat storage material 120.

In addition, by attaching the lid 180 to the double wall container 110, it is possible to transport the sample compactly and lightly.

EXPLANATION OF SYMBOLS

10: Transport device
110: Double wall container
120: Heat storage material
130: Auxiliary storage material
140: Temperature sensor
150: Storage container
160: Temperature controlling device
180: Lid.

The invention claimed is:

1. A transport device comprising:

a temperature controlling unit comprising a temperature controlling heat transferring body and a box body housing a heat transferring body and a cooling element, and a thermally insulated container comprising a cylindrical cavity, a thermal storage body provided on an inner wall of the cylindrical cavity, an open end defining a top of the thermally insulated container, and a closed end opposite from the open end and defining a bottom of the thermally insulated container, wherein:

the temperature controlling heat transferring body has a top and a bottom, the top being configured to receive a first lid and the bottom being fixed to the heat transferring body, the thermally insulated container is convertible between a first configuration and a second configuration, in the first configuration, the thermally insulated container is removably assembled on the temperature controlling unit through the open end of the thermally insulated container, so that the closed end of the thermally insulated container covers the top of the temperature controlling heat transferring body and the open end of the thermally insulated container engages with the box body to secure the thermally insulated container on the temperature controlling unit, in the second configuration, the thermally insulated container is configured to receive a second lid at the open end and to store an object in the cylindrical cavity, the thermal storage body is composed of a thermal storage material, and the temperature controlling unit is configured to perform thermal storage temperature control processing on the thermal storage body when the thermally insulated container is assembled on the temperature controlling unit.

2. The transport device according to claim 1, wherein in the first configuration, the temperature controlling heat transferring body is positioned to face an inner circumferential surface of the heat storage body.

3. The transport device according to claim 1, further comprising a first temperature sensor for measuring a temperature of the heat storage material, wherein the temperature controlling unit further comprises a controller for controlling the temperature of the temperature controlling heat transferring body on the basis of a measurement signal of the first temperature sensor.

4. The transport device according to claim 3, further comprising a second temperature sensor for measuring a temperature of the temperature controlling heat transferring body, wherein the controller further controls the temperature of the temperature controlling heat transferring body on the basis of a measurement signal of the second temperature sensor.

5. The transport device according to claim 1, wherein the cooling element is an electronic cooling element for cooling the temperature controlling heat transferring body.

6. The transport device according to claim 4, wherein the controller performs with respect to the temperature controlling heat transferring body:

a first process for performing a heat storage treatment on the heat storage body until a temperature on a side of the heat storage body opposite to the temperature controlling heat transferring body reaches a first temperature corresponding to the heat storage material, a second process of performing a temperature controlling treatment on the heat storage body so that a temperature on a same side of the heat storage body as the temperature controlling heat transferring body becomes a second temperature suitable for transport of a transported object; and a third process for maintaining the temperature of the heat storage body so that the heat storage body is maintained at the second temperature.

7. The transport device according to claim 1, wherein the temperature controlling unit further comprises a storage space formed inside the temperature controlling heat transferring body for storing a stored object so that the object can be freely put in and taken out.

8. The transport device according to claim 7, wherein the temperature controlling unit has a lid that can close the storage space so as to freely open and close.

9. The transport device according to claim 3, wherein the first temperature sensor is provided on the side opposite to the temperature controlling heat transferring body, in the thickness direction of the heat storage material.

10. The transport device according to claim 1, wherein:

the thermal storage body is provided in a thermal storage material cartridge, and the thermal storage material cartridge is attached to the thermally insulated container so that in the first configuration, the thermal storage material cartridge is removably fitted into the space between the temperature controlling unit and the thermally insulated container.

11. The transport device according to claim 1, wherein:

the temperature controlling transferring body comprises a lid that is configured to freely open and close, and an auxiliary heat storage material is mounted on a side of the lid facing the closed end of the thermally insulated container.

12. The transport device according to claim 1, wherein the cooling element is a Stirling cooler for cooling the temperature controlling heat transferring body.

13. A transport device comprising:

a temperature controlling unit comprising a temperature controlling heat transferring body and a box body housing a heat transferring body and a cooling element, and a thermally insulated container comprising an open end defining a top of the thermally insulated container, and a closed end opposite from the open end and defining a bottom of the thermally insulated container, wherein:

the temperature controlling heat transferring body has a top and a bottom, the top being configured to receive a first lid and the bottom being fixed to the heat transferring body, the thermally insulated container is convertible between a first configuration and a second configuration, in the first configuration, the thermally insulated container is removably assembled on the temperature controlling unit through the open end of the thermally insulated container, so that the closed end of the thermally insulated container covers the top of the temperature controlling heat transferring body and the open end of the thermally insulated container engages with the box body to secure the thermally insulated container on the temperature controlling unit, in the second configuration, the thermally insulated container is configured to receive a second lid at the open end and to store an object in the cylindrical cavity, and the temperature controlling unit is configured to perform thermal storage temperature controlling treatment on a thermal storage material disposed along an inner circumferential surface of the thermally insulated container, when the thermally insulated container is assembled on the temperature controlling unit.

14. The transport device according to claim 13, wherein the temperature controlling unit further comprises a storage space formed inside the temperature controlling heat transferring body for storing a stored object so that the object can be freely put in and taken out.

* * * * *